US005475979A

United States Patent [19]

Oag et al.

[11] Patent Number: 5,475,979

[45] Date of Patent: Dec. 19, 1995

[54] GAS TURBINE ENGINE COMBUSTION CHAMBER

[75] Inventors: Keith Oag, Rugby, England; Jeffrey D. Willis, Coventry, Great Britain; Alan Knocker, Coventry, England

[73] Assignee: Rolls-Royce, plc, London, England

[21] Appl. No.: 358,086

[22] Filed: Dec. 15, 1994

[30] Foreign Application Priority Data

Dec. 16, 1993 [GB] United Kingdom ..... 9325708

[51] Int. Cl.[6] ..... F02C 7/22

[52] U.S. Cl. ..... 60/737; 60/739; 60/747

[58] Field of Search ..... 60/737, 738, 739, 60/740, 747

[56] References Cited

U.S. PATENT DOCUMENTS 3,974,646 8/1976 Markowski et al. ..... 60/737
4,052,844 10/1977 Caruel et al. .
5,201,181 4/1993 Ohmori et al. ..... 60/747
5,251,447 10/1993 Joshi et al. ..... 60/737
5,321,948 6/1994 Leonard ..... 60/737
5,394,688 3/1995 Amos ..... 60/737

FOREIGN PATENT DOCUMENTS 2070140 3/1981 United Kingdom .

*Primary Examiner*—Louis J. Casaregola
*Attorney, Agent, or Firm*—Cushman Darby & Cushman

[57] ABSTRACT

A gas turbine engine combustion chamber has primary and secondary combustion zones. An annular secondary fuel and air mixing duct surrounds the primary combustion zone. The annular secondary fuel and air mixing duct is defined at its radially outer extremity by an annular wall. The annular wall is at least partially formed by an annular manifold. The annular manifold has a number of radially inwardly extending fuel injectors which inject fuel into the secondary fuel and air mixing duct. The annular fuel manifold is mechanically isolated from the remaining portion of the annular wall by an annular gap. The annular fuel manifold is supported from the combustor casing by a fuel supply pipe which is secured to the combustor casing and the annular fuel manifold.

15 Claims, 4 Drawing Sheets

GAS TURBINE ENGINE COMBUSTION CHAMBER

FIELD OF THE INVENTION

BACKGROUND OF THE INVENTION

The present invention relates to a gas turbine engine combustion chamber.

In order to meet the emission level requirements, for industrial low emission gas turbine engines, staged combustion is required in order to minimise the quantity of the oxides of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature and this requires premixing of the fuel and all the combustion air before combustion takes place. The oxides of nitrogen (NOx) are commonly reduced by a method which uses two stages of fuel injection. Our UK patent no. 1489339 discloses two stages of fuel injection to reduce NOx. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low i.e. less than the stoichiometric ratio.

The gas turbine engine combustion chamber in our UK patent no. 1489339 uses a tubular combustion chamber, whose axis is arranged substantially parallel to the axis of the gas turbine engine. The tubular combustion chamber has an annular secondary fuel and air mixing duct which surrounds the primary combustion zone. An annular fuel manifold is located within and at the upstream end of the annular secondary fuel and air mixing duct to inject fuel into the annular secondary fuel and air mixing duct.

SUMMARY OF THE INVENTION

The present invention is particularly concerned with gas turbine engines which have staged combustion, and is more particularly concerned with the secondary fuel and air mixing duct and secondary fuel injection or tertiary fuel and air mixing duct and tertiary fuel injection.

Accordingly the present invention provides a gas turbine engine combustion chamber comprising at least one combustion zone defined by at least one peripheral wall, means to define at least one fuel and air mixing duct for conducting a mixture of fuel and air to the at least one combustion zone, each mixing duct having an upstream end for receiving fuel and air and having a downstream end for delivering the fuel and air mixture into the at least one combustion zone, the at least one fuel and air mixing duct extending around the combustion chamber externally thereof, fuel injector means for injecting fuel into the at least one fuel and air mixing duct.

a fuel manifold for supplying fuel to the fuel injector means, the fuel manifold extending around the at least one fuel and air mixing duct externally thereof, wherein the fuel manifold and the at least one fuel and air mixing duct have common boundary wall means comprising at least a portion of their streamwise extents.

The combustion chamber may have a primary combustion zone and a secondary combustion zone downstream of the primary combustion zone, the at least one fuel and air mixing duct delivers the fuel and air mixture into the secondary combustion zone.

The peripheral wall may be annular, the at least one fuel and air mixing duct is arranged around the primary combustion zone.

The at least one fuel and air mixing duct may be defined at its radially inner extremity and radially outer extremity by a pair of annular walls, the fuel manifold comprises a portion of the outer annular wall of the pair of annular walls.

A combustor casing may enclose the combustion chamber, a fuel supply pipe extends through an aperture in the casing and is in fluid flow communication with the fuel manifold, the fuel supply pipe is secured to the combustor casing and the inner end of the fuel supply pipe is secured to the fuel manifold so that the combustor casing supports the fuel manifold.

The manifold may be mechanically isolated from the combustion chamber.

The secondary fuel injector means may comprise a plurality of hollow cylindrical members extending radially from the fuel manifold into the at least one secondary fuel and air mixing duct.

The hollow cylindrical members may extend radially inwardly.

The fuel manifold may form an upstream portion of the outer annular wall of the pair of annular walls.

The fuel manifold may form an intermediate portion of the outer annular wall of the pair of annular walls.

Preferably the fuel manifold is spaced from a downstream portion of the outer annular wall of the pair of annular walls to mechanically isolate the fuel manifold from the combustion chamber.

Preferably a seal is arranged between the fuel manifold and the downstream portion of the outer annular wall.

BRIEF DESCRIPTION OF THE INVENTION

The present invention will be more fully described by way of example with reference to the accompanying drawings, in which.

Figure 1:
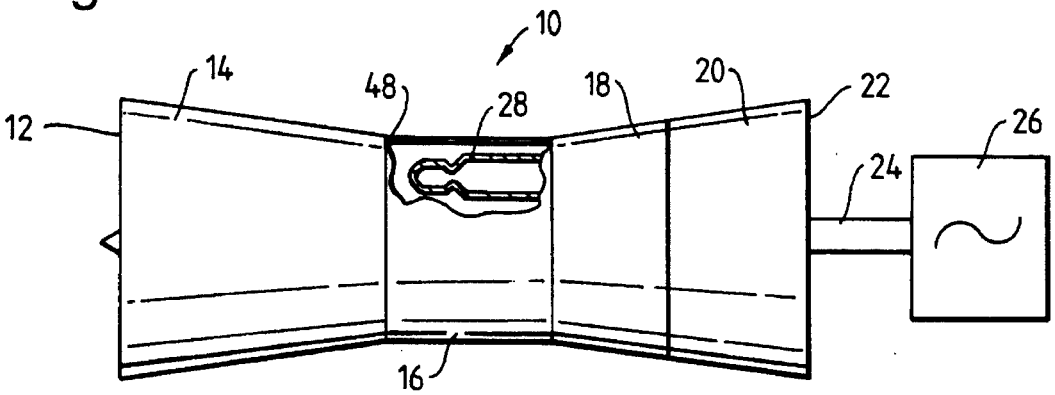
FIG. 1 is a view of a gas turbine engine having a combustion chamber assembly according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26 via a shaft 24. However the power turbine section 20 may be arranged to provide drive for other purposes. The operation of the gas turbine engine 10 is quite conventional, and will not be discussed further.

The combustion chamber assembly 16 comprises a plurality of equally circumferentially spaced tubular combustion chambers 28. The axes of the tubular combustion chambers 28 are arranged to extend substantially parallel to the axis of the gas turbine engine. The inlets of the tubular combustion chambers 28 are at their axially upstream end and their outlets are at their axially downstream ends.

Each of the tubular combustion chambers 28 comprises an upstream end wall 30 secured to the upstream end of an annular wall 32. A first, upstream, portion 34 of the annular wall 32 defines a primary combustion zone 36, and a second, downstream, portion 38 of the annular wall 32 defines a secondary combustion zone 40. The second portion 38 of the annular wall 32 has a greater diameter than the first portion 34. The downstream end of the first portion 34 has a frustoconical portion 42 which reduces in diameter to a throat 44. A further frustoconical portion 46 interconnects the throat 44 at the downstream end of the first portion 34 and the upstream end of the second portion 38.

A combustor casing 48 is provided, and the combustor casing 48 is located coaxially with the axis of the gas turbine engine and surrounds all of the tubular combustion chambers 28.

The upstream end wall 30 of each of the tubular combustion chambers 28 has an aperture 50 to allow the supply of air and fuel into the primary combustion zone 36. An axial flow swirler 52 is arranged coaxially with the aperture 50 in the upstream end wall 30, and a primary fuel injector 54 is located coaxially within the axial flow swirler 52. The aperture 50 is also arranged coaxially with the axis of the tubular combustion chamber 28.

A secondary fuel and air mixing duct 56 is provided for each of the tubular combustion chambers 28. Each secondary fuel and air mixing duct 56 is arranged around the primary combustion zone 36 of the respective tubular combustion chambers 28. The secondary fuel and air mixing ducts 56 are annular and each secondary fuel and air mixing duct 56 is defined between a second annular wall 58 and a third annular wall 60. The second annular walls 58 define the radially inner extremity with respect to the axes of the combustion chambers 28, of each of the secondary fuel and air mixing ducts 56 and the third annular walls 60 define the radially outer extremity, with respect to the axes of the combustion chambers 28 of each of the secondary fuel and air mixing ducts 56. The secondary fuel and air mixing duct 56 of each tubular combustion chamber 28 has a secondary air intake 62 defined radially, with respect to the axis of the combustion chamber, between the upstream end 64 of the third annular wall 60 and the second annular wall 58. The upstream end 66 of the second annular wall 58 extends axially upstream of the upstream end wall 30 of the respective tubular combustion chamber 28.

A plurality of secondary fuel injectors 68 are provided for the secondary fuel and air mixing duct 56 of each tubular combustion chamber 28. Each of the secondary fuel injectors 68 comprises a hollow cylindrical member which extends radially with respect to the axis of the tubular combustion chamber 28. Each of the hollow cylindrical members 68 supplies fuel into the upstream end of the secondary fuel and air mixing duct 56. Each hollow cylindrical member 68 is provided with a plurality of apertures 70 through which the fuel is injected into the secondary fuel and air mixing duct 56. The apertures 70 are of equal diameters and are spaced apart axially along the hollow cylindrical member 68 at suitable positions, and the apertures 70 are arranged at diametrically opposite sides of the hollow cylindrical member 68 so that the fuel injectors inject the fuel circumferentially with respect to the axis of the tubular combustion chamber 28.

Each second and third annular wall 58 and 60 is arranged coaxially around the first portion 34 of the annular wall 32. At the downstream end of the secondary fuel and air mixing duct 56 of each tubular combustion chamber 28, the second and third annular walls 58 and 60 are secured to the respective frustoconical portion 46, and each frustoconical portion 46 is provided with a plurality of equi-circumferentially spaced apertures 72 which are arranged to direct fuel and air into the secondary combustion zone 40 in the tubular combustion chamber 28, in a downstream direction towards the axis of the tubular combustion chamber 28. The apertures 72 may be circular or slots. All of the apertures 72 are arranged to have the same flow area.

The secondary fuel injectors 68 for each of the tubular combustion chambers 28 are supplied with fuel from a respective one of a plurality of annular fuel manifolds 74. Each annular fuel manifold 74 is arranged coaxially with its associated tubular combustion chamber 28 and the annular fuel manifold 74 forms an upstream portion 76 of the third annular wall 60. The annular fuel manifold comprises an inner annular wall 73 and an outer annular wall 75 which are secured together at their upstream and downstream ends by welds or other suitable means. A boss 79 is secured in an aperture 77 in the outer annular wall 75. The annular fuel manifold 74 is mechanically isolated from a downstream portion 78 of the third annular wall 60 by an annular slot 80. An annular seal 82 is located in the slot 80. Each annular fuel manifold 74 is supplied with fuel by a respective one of a plurality of fuel supply pipes 84. Each fuel supply pipe 84 effectively extends through a respective one of a number of apertures 86 in the combustion casing 48, and each fuel supply pipe 84 is effectively secured to the combustor casing 48. Each supply pipe 84 fits into a respective plug 88 which is bolted or otherwise secured onto a respective boss 90 on the combustor casing 48. Each plug 88 is also secured at its inner end to the boss 79 of the associated annular fuel manifold 74, by bolts 83 and pins 81 or other suitable means and thus the combustor casing 48 supports each of the annular fuel manifolds 74 by the fuel supply pipes 84 and plugs 88. The annular slot 80 allows relative thermal growth to occur between the annular fuel manifold 74 and the wall portion 78 of the annular secondary fuel and air mixing duct 56.

Thus it can be seen that the fuel manifold 74 and the secondary fuel and air mixing duct 56 share a common boundary wall 76 over a portion of their streamwise extents.

Although the description has referred to a single secondary fuel and air mixing duct for each tubular combustion chamber it may be possible to divide the annular secondary fuel and air mixing duct into a number of separate secondary fuel and air mixing ducts and to provide a secondary injector for each duct as disclosed in our earlier UK patent application no. 9310690.4 filed on May 24, 1993.

Figure 4:
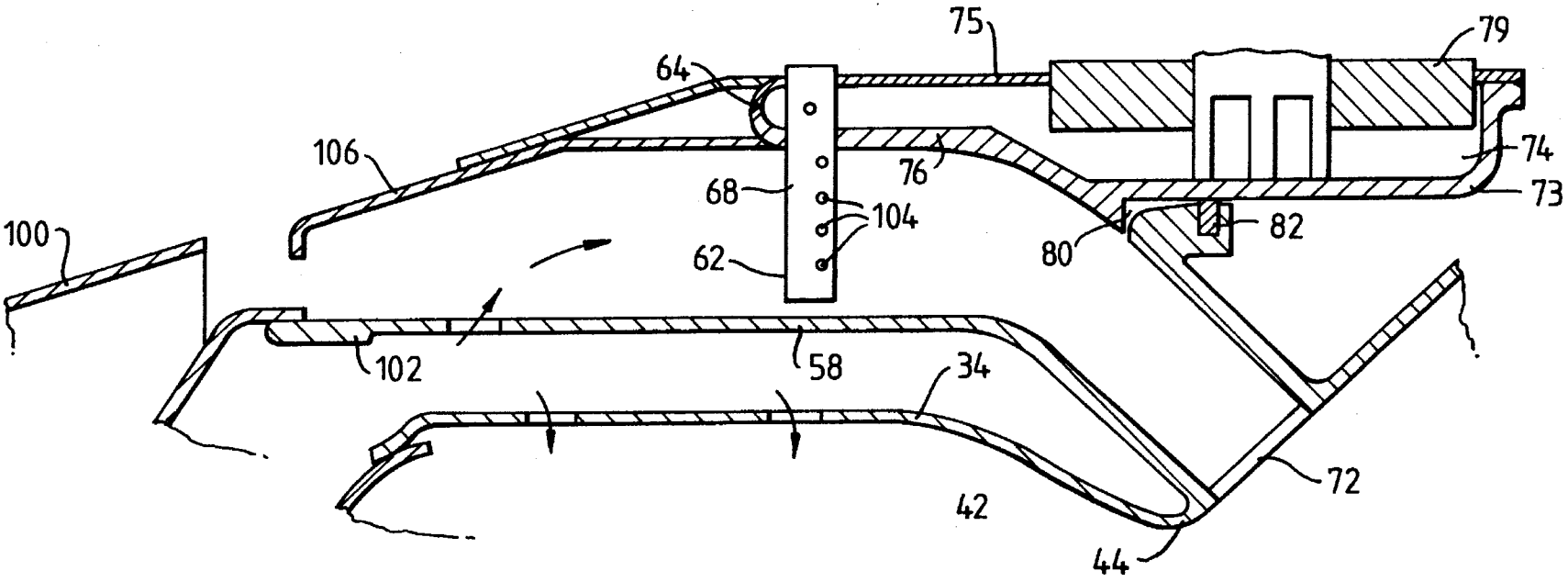
FIG. 4 is an enlarged longitudinal cross-sectional view through an alternative combustion chamber according to the present invention.

In FIG. 4 a further combustion chamber according to the present invention is shown. This arrangement differs from the previous arrangement in that a frustoconical member 100 positioned upstream of the combustion chamber defines the duct for the entry of pilot, primary and secondary air. The second annular wall 58 has a number of apertures 102 to allow the secondary air to flow into the secondary fuel and air mixing ducts 56. The apertures 104 in the cylindrical member 68 are arranged such that their axes are 90° to each other and so that they inject the fuel with a circumferential component with respect to the axis of the tubular combustion chamber 28 and also with an axial component with respect to the axis of the tubular combustion chamber 28. The axes of the apertures 104 are arranged at 45° to a plane perpendicular to the axis of the combustion chamber 28 and containing the axes of the cylindrical members 68. The axes of the apertures 104 in each cylindrical member 68 are arranged at 45° to a plane containing the axis of the tubular combustion chamber 28 and containing the axis of the particular cylindrical member 68. The annular fuel manifold 76 thus forms an intermediate portion of the outer annular wall of the pair of annular walls defining the secondary fuel and air mixing duct 56. There is also a wall 106 upstream of the fuel manifold 76 which defines the outer annular wall of the secondary fuel and air mixing duct 56, and extends radially inwardly towards the inner annular wall 58 to close the gap at its most upstream end.

Figure 3:
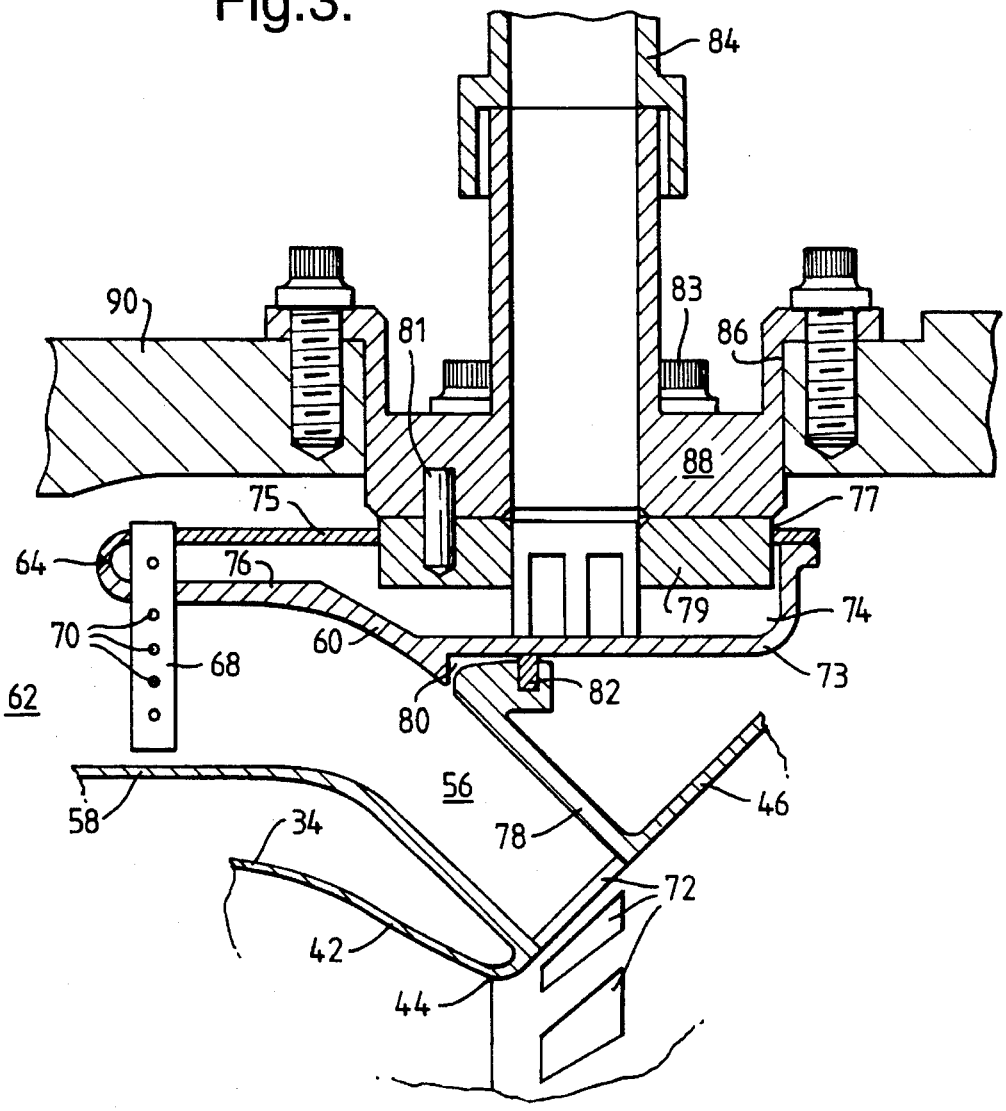
FIG. 3 is a further enlarged longitudinal cross-sectional view through the upstream end of the combustion chamber shown in FIG. 2.
Figure 2:
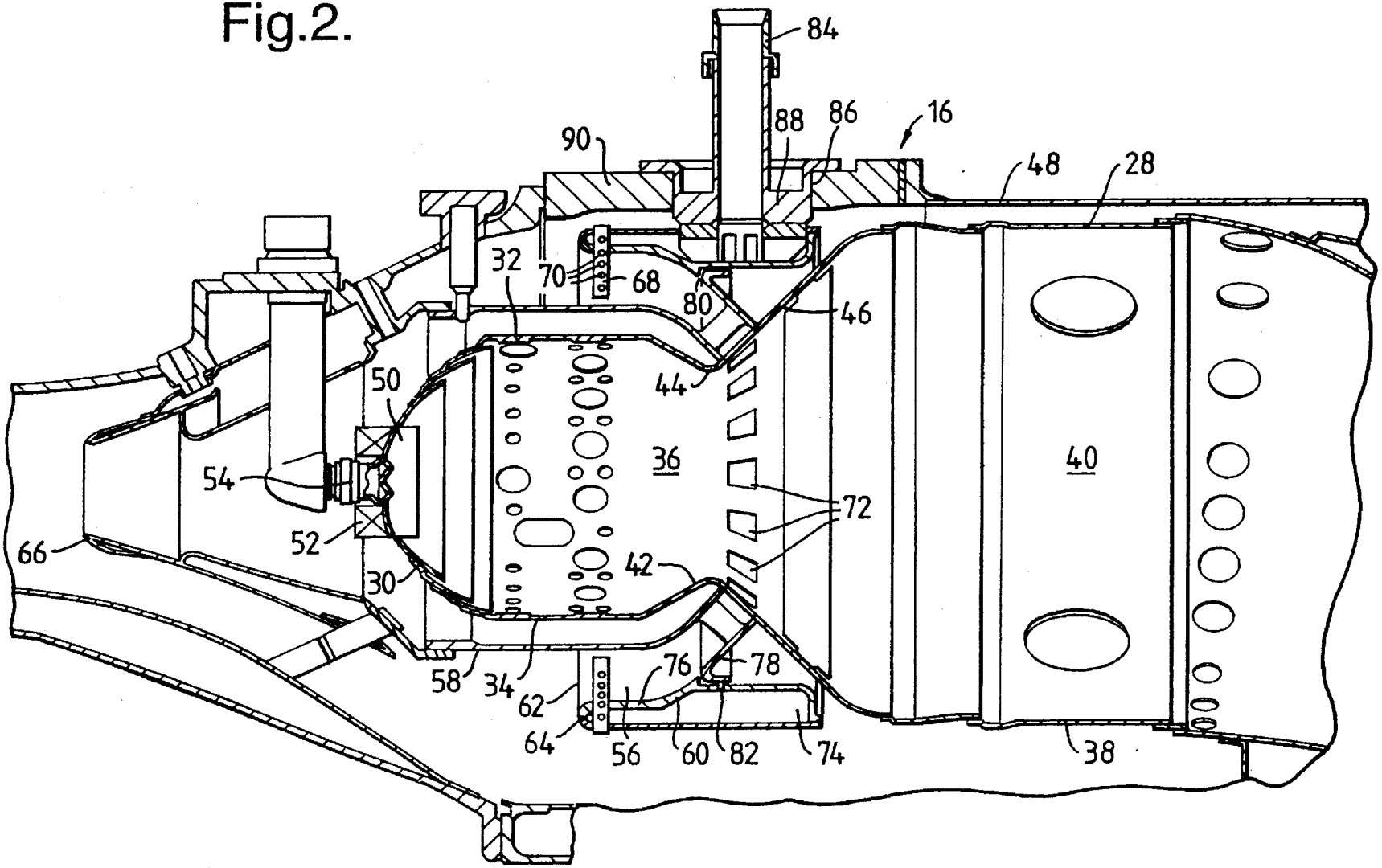
FIG. 2 is an enlarged longitudinal cross-sectional view through the combustion chamber shown in FIG. 1.
Figure 5:
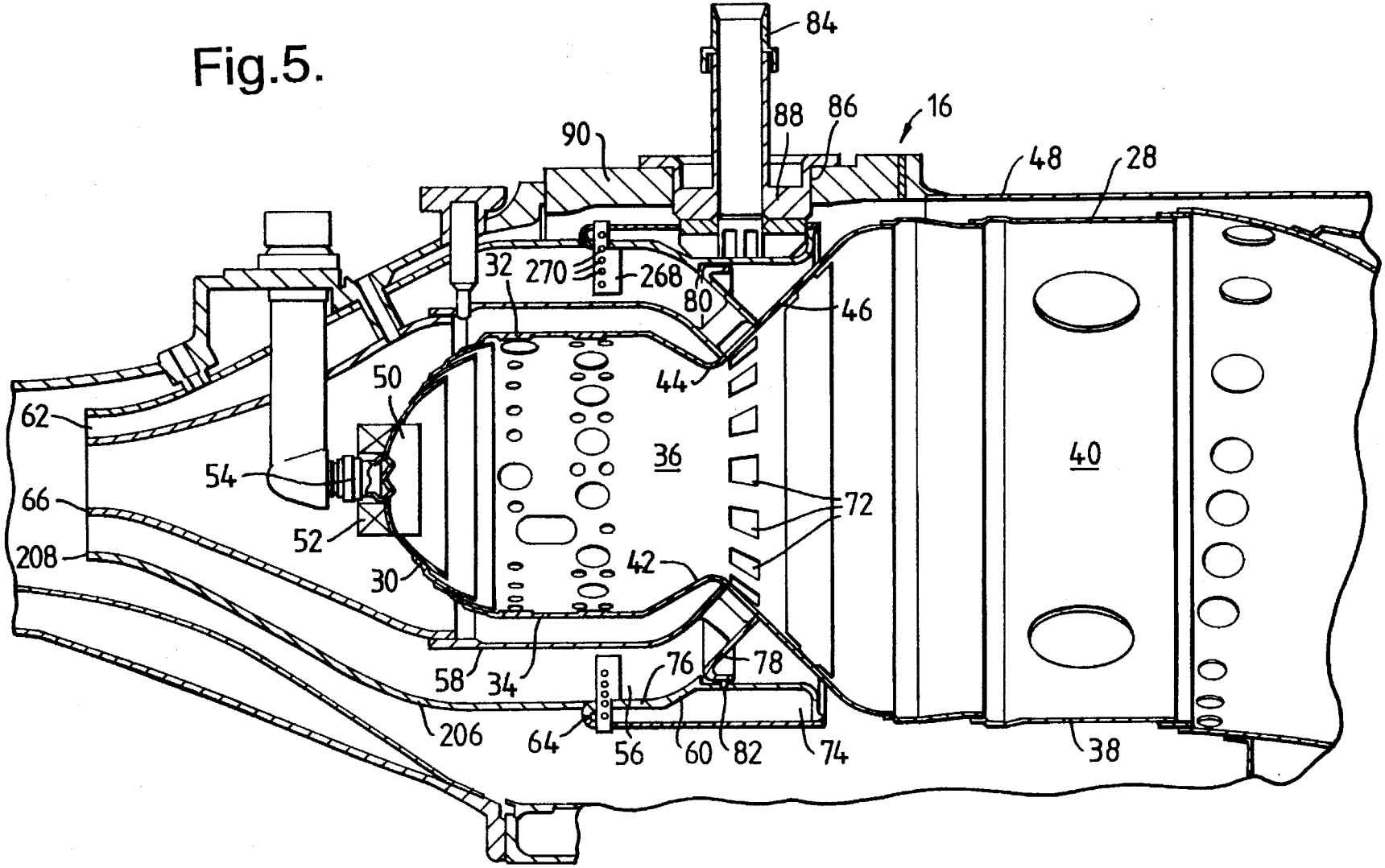
FIG. 5 is an enlarged longitudinal cross-sectional view through a further alternative combustion chamber according to the present invention.

In FIG. 5 a further combustion chamber according to the present invention is shown. This arrangement differs from that in FIGS. 2 and 3 in that the annular fuel manifold 76 forms an intermediate portion of the outer annular wall of the pair of annular walls defining the secondary fuel and air mixing duct 56. There is also a wall 206 upstream of the fuel manifold 76 which defines the outer annular wall of the secondary fuel and air mixing duct 56, the wall 206 has an upstream end 208 substantially at the same axial position as the upstream end 66 of the inner annular wall 58. Thus the secondary air intake 62, defined between the upstream end 62 of the inner annular wall 58 and the upstream end 208 of the wall 206, is axially upstream of the tubular combustion chamber 28 and is in the same plane as the air intake for the primary combustion zone 36 of the tubular combustion chamber 28.

A further difference is that each of the secondary fuel injectors 268 comprises a hollow aerofoil shaped member which extends radially with respect to the axis of the tubular combustion chamber 28. These changes reduce recirculation zones, or turbulent zones, within the secondary fuel and air mixing duct 56 which are responsible for allowing precombustion of the fuel in the secondary fuel and air mixing duct 56. In particular it minimises wakes immediately downstream of the fuel injectors 268. The apertures 270 direct the fuel circumferentially with respect to the axis of the tubular combustion chamber 28.

The advantage of using the fuel manifold to define the outer annular wall of the fuel and air mixing duct is that the fuel manifold is not within the fuel and air mixing duct and therefore it does not interfere with the airflow through the fuel and air mixing duct. Hence the airflow is smoother with less recirculation and turbulence minimising the possibility of precombustion in the fuel and air mixing duct.

It is also possible to arrange an annular fuel manifold to define at least a portion of an outer annular wall of a tertiary fuel and air mixing duct in the case of a three stage combustion chamber.

In its broadest aspect the invention provides a fuel manifold to define a portion of an outer wall of a fuel and air mixing duct for a lean burn combustion zone of a gas turbine engine combustion chamber.

We claim:

1. A gas turbine engine combustion chamber comprising at least one combustion zone defined by at least one peripheral wall, means to define at least one fuel and air mixing duct for conducting a mixture of fuel and air to the at least one combustion zone, each mixing duct having an upstream end for receiving fuel and air and having a downstream end for delivering the fuel and air mixture into the at least one combustion zone, the at least one fuel and air mixing duct extending around the combustion chamber externally thereof, fuel injector means for injecting fuel into the at least one fuel and air mixing duct;

a fuel manifold for supplying fuel to the fuel injector means, the fuel manifold extending around the at least one fuel and air mixing duct externally thereof, wherein the fuel manifold and the at least one fuel and air mixing duct have common boundary wall means including at least a portion extending in the direction of flow over said boundary wall means;

said combustion chamber being enclosed by a combustor casing, a fuel supply pipe extending through an aperture in said casing and being in fluid flow communication with said fuel manifold, said fuel supply pipe being secured to said combustor casing, said fuel supply pipe having an inner end secured to said fuel manifold so that the combustor casing supports the fuel manifold, said fuel manifold being relatively moveable with respect to said combustion chamber.

2. A gas turbine engine as claimed in claim 1 in which the combustion chamber has a primary combustion zone and a secondary combustion zone downstream of the primary combustion zone, the at least one fuel and air mixing duct delivers the fuel and air mixture into the secondary combustion zone.

3. A combustion chamber as claimed in claim 2 in which the peripheral wall is annular, the at least one fuel and air mixing duct is arranged around the primary combustion zone.

4. A combustion chamber as claimed in claim 3 in which the at least one fuel and air mixing duct is defined at its radially inner extremity and radially outer extremity by a pair of annular walls, the fuel manifold comprises a portion of the outer annular wall of the pair of annular walls.

5. A combustion chamber as claimed in claim 1 in which a combustor casing encloses the combustion chamber, a fuel supply pipe extends through an aperture in the casing and is in fluid flow communication with the fuel manifold, the fuel supply pipe is secured to the combustor casing and the inner end of the fuel supply pipe is secured to the fuel manifold so that the combustor casing supports the fuel manifold.

6. A combustion chamber as claimed in claim 5 in which the manifold is mechanically isolated from the combustion chamber.

7. A combustion chamber as claimed in claim 2 in which a secondary fuel injector means is provided and comprises a plurality of hollow cylindrical members extending radially from the fuel manifold into the at least one secondary fuel and air mixing duct.

8. A combustion chamber as claimed in claim 7 in which the hollow cylindrical members extend radially inwardly.

9. A combustion chamber as claimed in claim 4 in which the fuel manifold forms an upstream portion of the outer annular wall of the pair of annular walls.

10. A combustion chamber as claimed in claim 4 in which the fuel manifold forms an intermediate portion of the outer annular wall of the pair of annular walls.

11. A combustion chamber as claimed in claim 1 in which a seal is arranged between the fuel manifold and the downstream portion of the outer annular wall.

12. A combustion chamber as claimed in claim 2 in which a secondary fuel injector means is provided and comprises a plurality of aerofoil shaped members extending radially from the fuel manifold into the at least one secondary fuel and air mixing duct.

13. A combustion chamber as claimed in claim 12 in which the aerofoil shaped members extend radially inwardly, 14. A combustion chamber as claimed in claim 9 or claim 10 in which an upstream portion of the outer annular wall has an upstream end upstream of the combustion chamber.

15. The gas turbine engine combustion chamber as claimed in claim 1 wherein a plurality of said combustion chambers are arranged within a single combustor casing.

* * * * *